US006182579B1

(12) United States Patent
Chang

(10) Patent No.: US 6,182,579 B1
(45) Date of Patent: Feb. 6, 2001

(54) OFFICE DESK WITH MULTIPLE TRAYS PIVOTALLY CONNECTED THERETO

(76) Inventor: Chien-Kuo Chang, F1. 10-2, No. 447, Sec. 3, Wen-Hsin Rd., Taichung (TW)

( * ) Notice: Under 35 U.S.C. 154(b), the term of this patent shall be extended for 0 days.

(21) Appl. No.: 09/391,481

(22) Filed: Sep. 8, 1999

(51) Int. Cl.[7] ..... A47B 37/00
(52) U.S. Cl. ..... 108/50.01; 108/94
(58) Field of Search ..... 108/50.01, 50.02, 108/50.11, 143, 92, 93, 94, 95; 312/195, 196, 223.6, 223.3; 248/918

(56) References Cited

U.S. PATENT DOCUMENTS 2,716,582 * 8/1955 Rosenfeld ..... 108/118 X
5,357,873 * 10/1994 Hilton ..... 108/50.01
5,704,299 * 1/1998 Corpuz, Jr. et al. ..... 108/50.01
5,845,586 * 12/1998 Moore ..... 108/50.01
5,967,631 * 10/1999 Ko ..... 108/50.01 X
5,992,810 * 11/1999 Crinion et al. ..... 108/50.01 X

FOREIGN PATENT DOCUMENTS

1129499 * 1/1957 (FR) ..... 108/118

* cited by examiner

*Primary Examiner*—Jose V. Chen
(74) *Attorney, Agent, or Firm*—Rosenberg, Klein & Lee

(57) ABSTRACT

A desk includes two inverted U-shaped frames connected with each other and each frame has two legs connected by a bar. A top supported on the two bars of the two frames. Each leg of the two frames has a tube connected to a distal end thereof and each tube has an open end so as to be pivotally connected to an auxiliary device such as a document tray or a support platform.

4 Claims, 3 Drawing Sheets

OFFICE DESK WITH MULTIPLE TRAYS PIVOTALLY CONNECTED THERETO

FIELD OF THE INVENTION

The present invention relates to a desk which is composed of tubes and a plurality of supporting frames are attached to the tubes so that computer, facsimile machine and so on are placed on the frames and the user is easily to access.

BACKGROUND OF THE INVENTION

A conventional desk generally includes a top with four legs and a drawer unit is put beside the desk so that the computer, the facsimile machine, the telephone and the document tray are put one the top of the desk. Although the user can easily access the office appliance, they occupy too much area of the top and only a limited area on the top can be used by the user. Furthermore, the locations of the facsimile machine and/or the other document trays could far from the user so that the user has to shift his chair to access the facsimile machine or the document trays. In fact, the space above the top of the desk is seldom used so that the present invention intends to provide a desk having different auxiliary device which are connected to the desk and easily to reach so as to meet the requirement of the user.

SUMMARY OF THE INVENTION

In accordance with one aspect of the present invention, a desk is provided and comprises a first inverted U-shaped frame having two first legs with a bar connected between the two first legs, and a second inverted U-shaped frame having two second legs with a bar connected the two second legs. Each of the two first legs is connected to the second leg corresponding thereto at a intermediate point thereof. Each leg has a first tube connected to a distal end thereof and each of the two first tubes has an open end. Each second leg has a second tube connected to a distal end thereof. A top is supported on the two bars of the first inverted U-shaped frame and the second inverted U-shaped frame. An auxiliary device has an insertion which is inserted into the open end of one of the two first tubes.

The main object of the present invention is to provide a desk having a tubes connected to the two sets of inverted frames and each tube has an open end so as to connect an auxiliary device so that the auxiliary device is located near the user.

Further objects, advantages, and features of the present invention will become apparent from the following detailed description with appropriate reference to the accompanying drawings.

DETAILED DESCRIPTION OF THE PREFERRED EMBODIMENT

Figure 1:
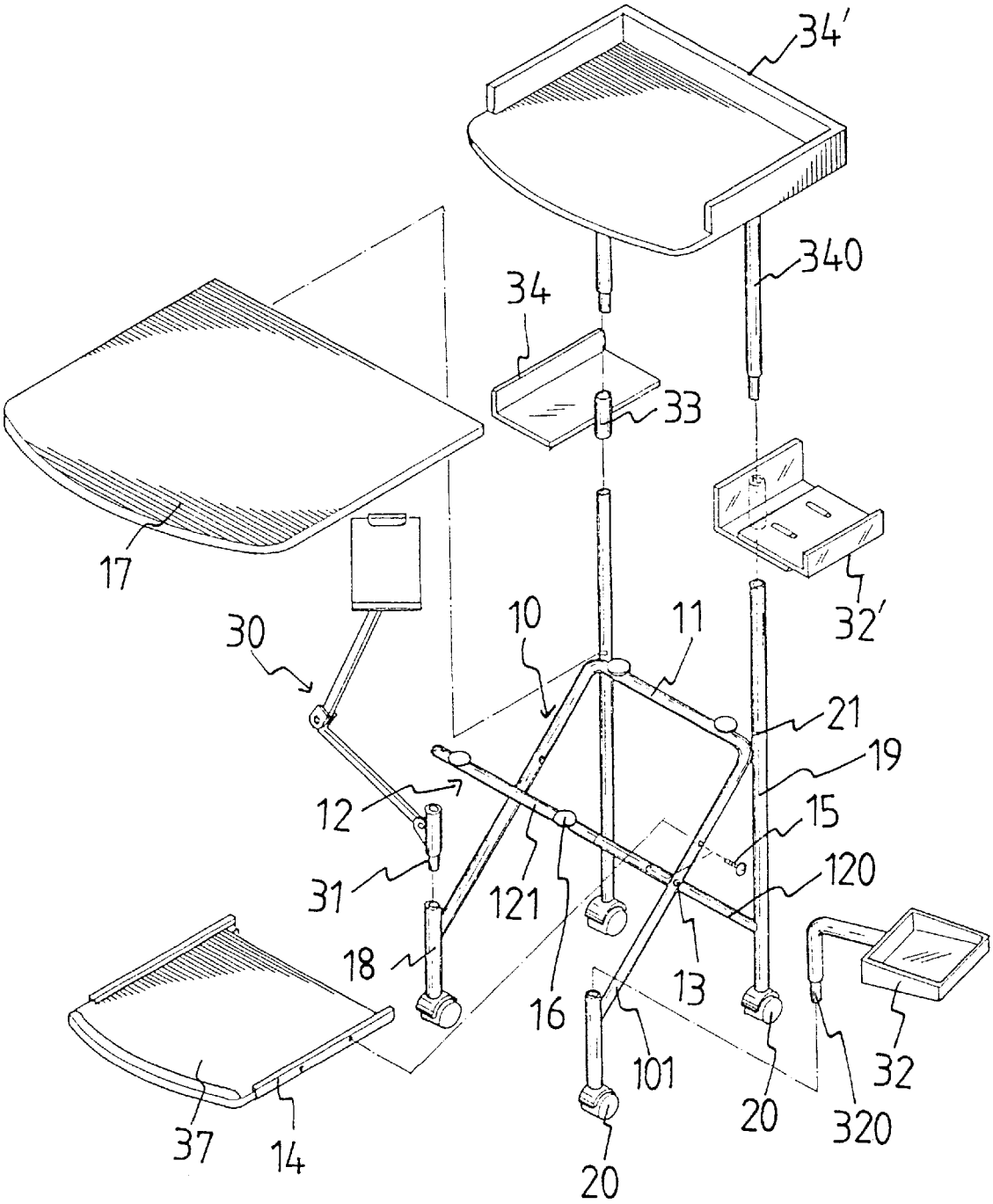
FIG. 1 is an exploded view of the desk and the auxiliary devices in accordance with the present invention.
Figure 2:
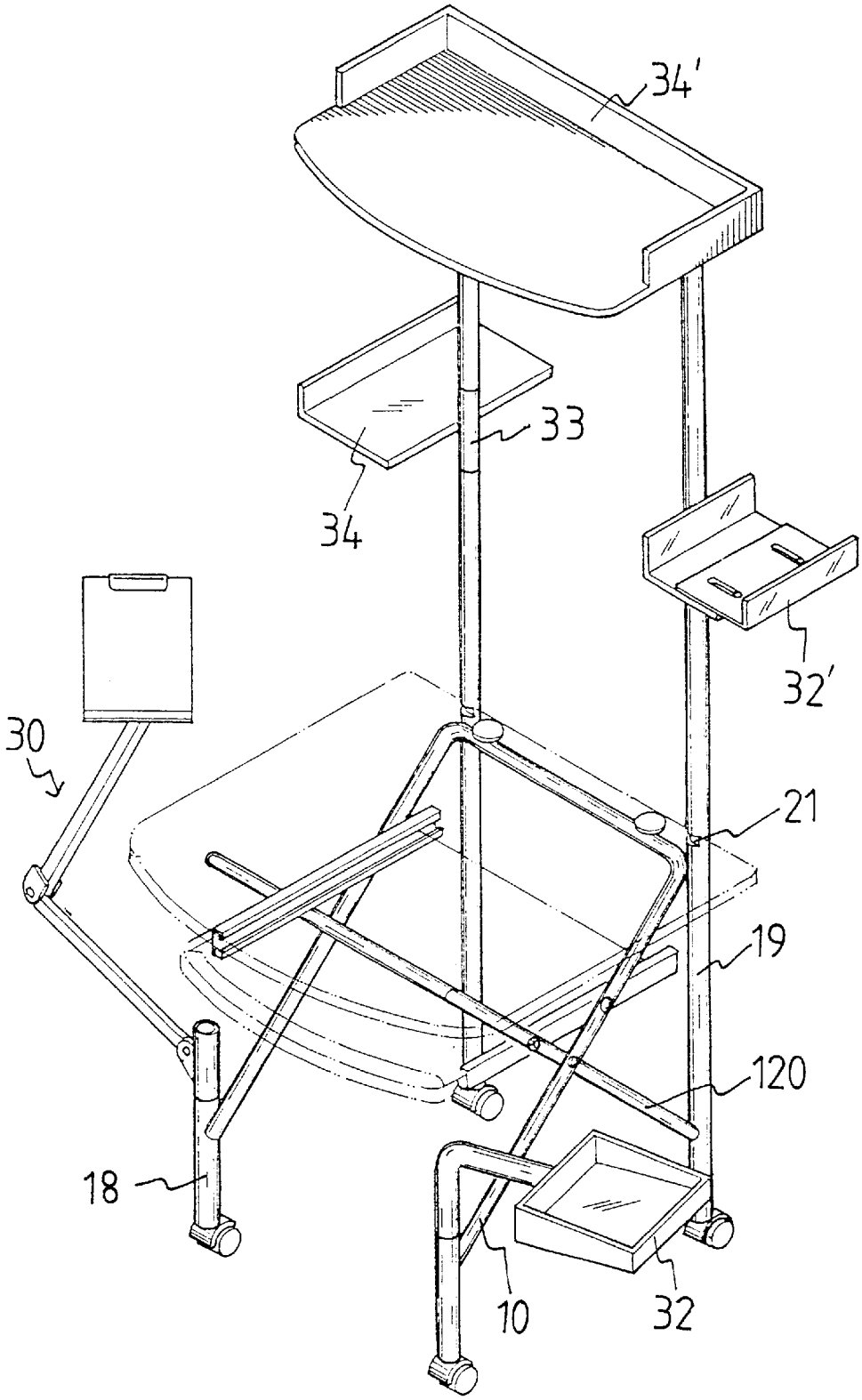
FIG. 2 is a perspective view of the desk with the auxiliary devices in accordance with the present invention connected thereto.

Referring to FIGS. 1 and 2, the desk of the present invention comprises a first inverted U-shaped frame 10 and a second inverted U-shaped frame 12. The first inverted U-shaped frame 10 has two first legs 101 with a bar 11 connected between the two first legs 101. Each leg 101 has a first tube 18 connected to a distal end thereof and each of the two first tubes 18 has an open first end. The two first tubes 18 each has a wheel 20 connected to a second end thereof.

The second inverted U-shaped frame 12 has two second legs 120 with a bar 121 connected the two second legs 120. Each second leg 120 has a second tube 19 connected to a distal end thereof. The two second tubes 19 each have an open first end and a wheel 20 is connected to a second end of each second tube 19. Each first leg 101 is connected to the second leg 120 corresponding thereto at a mediated point 13 thereof. Each bar 11/121 has two pads 16 connected thereto so that a top 17 is supported on the pads 16 of the two bars 11, 121 of the first inverted U-shaped frame 10 and the second inverted U-shaped frame 12. Each of the two second tubes 19 further has a notch 21 defined radially therein so as to received a side of the top 17.

Two rails each are connected to said first leg and said second leg which are connected with each other by extending bolts 15 through the first legs 101 and the second legs 120 and connected to the rails 14 so that a keyboard shelf 37 is slidably connected between the two rails 14 beneath the top 17.

An auxiliary device such as a document tray 32 has an insertion 320 which is pivotally inserted into the open first end of one of the two first tubes 18. A copy holder 30 has an insertion 31 which is pivotally inserted into the other first tube 18. A tray 34' has two posts 340 which are inserted into the two open first ends of the two second tubes 19. If needed, a document tray 34/32' which has a connecting tube 33 and the connecting tube 33 is connected between one of the posts 340 and the first open end of one of the second legs 19.

Figure 3:
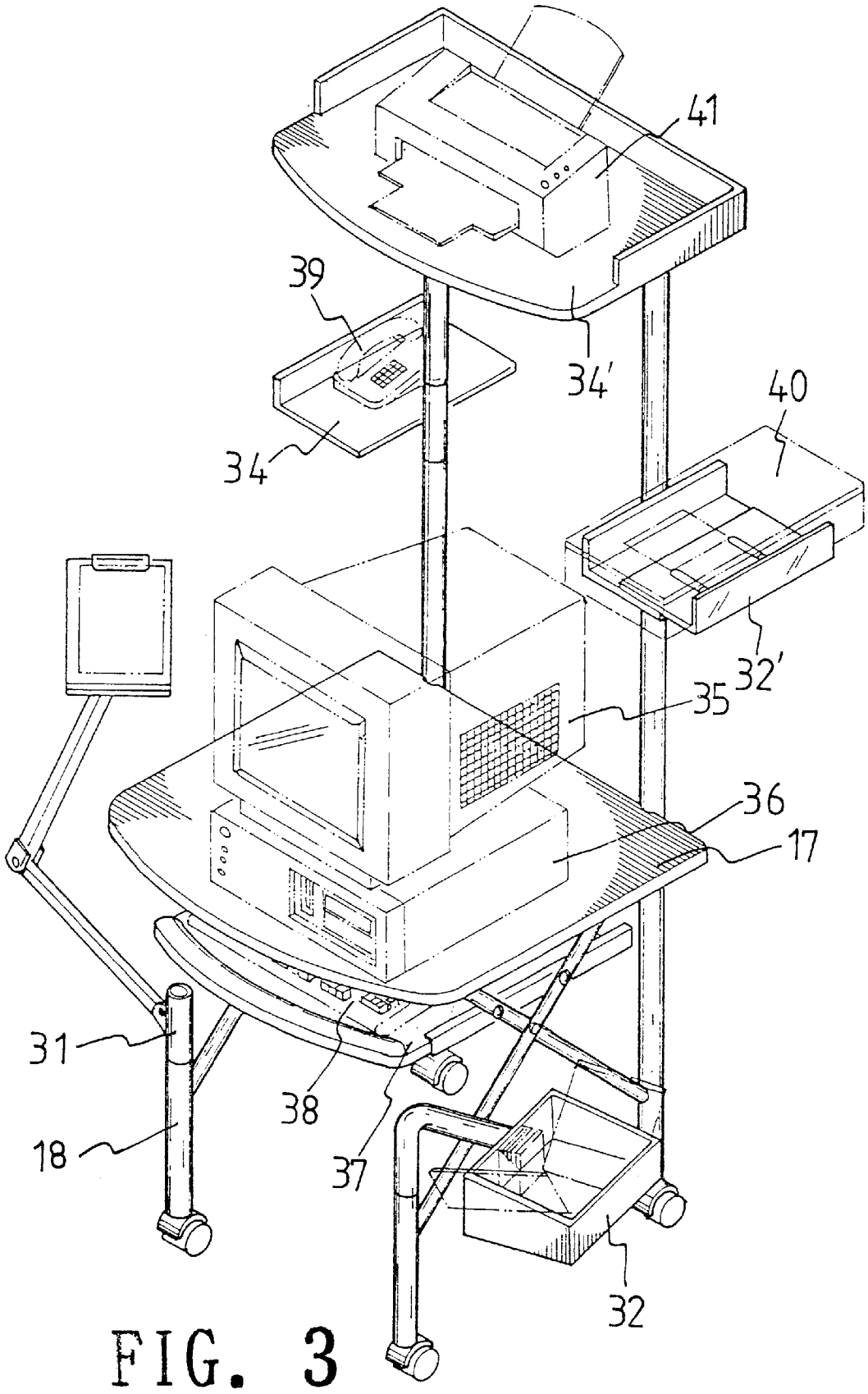
FIG. 3 is an illustrative view to illustrate office appliance put on the auxiliary devices of the desk of the present invention.

Therefore, referring to FIG. 3, all the auxiliary devices are located near the user so that the user can easily access the auxiliary devices without leaving from his/her desk. As shown in FIG. 3, a facsimile machine 41 is put on the tray 34', a telephone 39 is put on the document tray 34, the document is put on the document tray 32', and a computer set 35/36 is put on the top 17.

The desk of the present invention uses the space above the top 17 and the space below the top 17. The user needs not to leave his/her chair and his/her hands can reach the office appliance.

The invention is not limited to the above embodiment but various modification thereof may be made. It will be understood by those skilled in the art that various changes in form and detail may made without departing from the scope and spirit of the present invention.

What is claimed is:

1. An office desk with multiple trays pivotally connected thereto comprising:

a first inverted U-shaped frame having two first legs with a bar connected between said two first legs, each leg having a first tube connected to a distal end thereof and each of said two first tubes having an open first end, a second inverted U-shaped frame having two second legs with a bar connected said two second legs, each second leg having a second tube connected to a distal end thereof, each first leg connected to said second leg corresponding thereto at an intermediate point thereof;

a top supported on said two bars of said first inverted U-shaped frame and said second inverted U-shaped frame, and an auxiliary device having an insertion inserted into said open first end of one of said two it tubes.

2. The desk as claimed in claim 1, wherein each of said two second tubes has a notch defined therein so as to received a side of said top.

3. The desk as claimed in claim 1, wherein each of said two second tubes has an open first end and a tray having two posts which are inserted into said two open first ends of said two second tubes.

4. The desk as claimed in claim 3 further comprising a document tray which has a connecting tube and said connecting tube connected between one of said posts and said first open end of one of said second legs.

* * * * *